US005343922A

United States Patent [19]

Rankl et al.

[11] Patent Number: 5,343,922

[45] Date of Patent: Sep. 6, 1994

[54] SLATTED CURTAIN FOR ROLLER BLINDS

[75] Inventors: Gerald Rankl, Hof; Gerhard Haubenwallner, Ybbs, both of Austria

[73] Assignee: Gerald Rankl, Hof, Austria

[21] Appl. No.: 901,598

[22] Filed: Jun. 19, 1992

[30] Foreign Application Priority Data

Jun. 20, 1991 [DE] Fed. Rep. of Germany ..... 4120424

[51] Int. Cl.[5] ..... E06B 9/08

[52] U.S. Cl. ..... 160/133; 160/235; 160/236

[58] Field of Search ..... 160/133, 232, 235, 236; 264/273

[56] References Cited

U.S. PATENT DOCUMENTS 827,676 7/1906 Vance ..... 160/235 X
827,677 7/1906 Vance ..... 160/232
4,343,340 8/1982 Paisle ..... 160/236 X
4,601,953 7/1986 Haffer ..... 160/236 X
4,723,588 2/1988 Rüpel ..... 160/236
5,165,460 11/1992 Guthrie ..... 160/236 X

FOREIGN PATENT DOCUMENTS 2505682 8/1976 Fed. Rep. of Germany .
2614929 11/1988 France ..... 160/235
271841 2/1930 Italy ..... 160/235
WO87/06974 11/1987 PCT Int'l Appl. .
634630 2/1983 Switzerland .

*Primary Examiner*—David A. Scherbel
*Assistant Examiner*—Derek J. Berger
*Attorney, Agent, or Firm*—Flynn, Thiel, Boutell & Tanis

[57] ABSTRACT

A slatted curtain for roller blinds has slats (1, 2, 3) which are made of compressed or cast wood and into which a carrier element (4, 5, 6) is pressed or cast. The carrier elements (4, 5, 6) have hook-shaped joint portions (7, 8) for interconnecting the slats (1, 2, 3).

12 Claims, 1 Drawing Sheet

FIG. 1
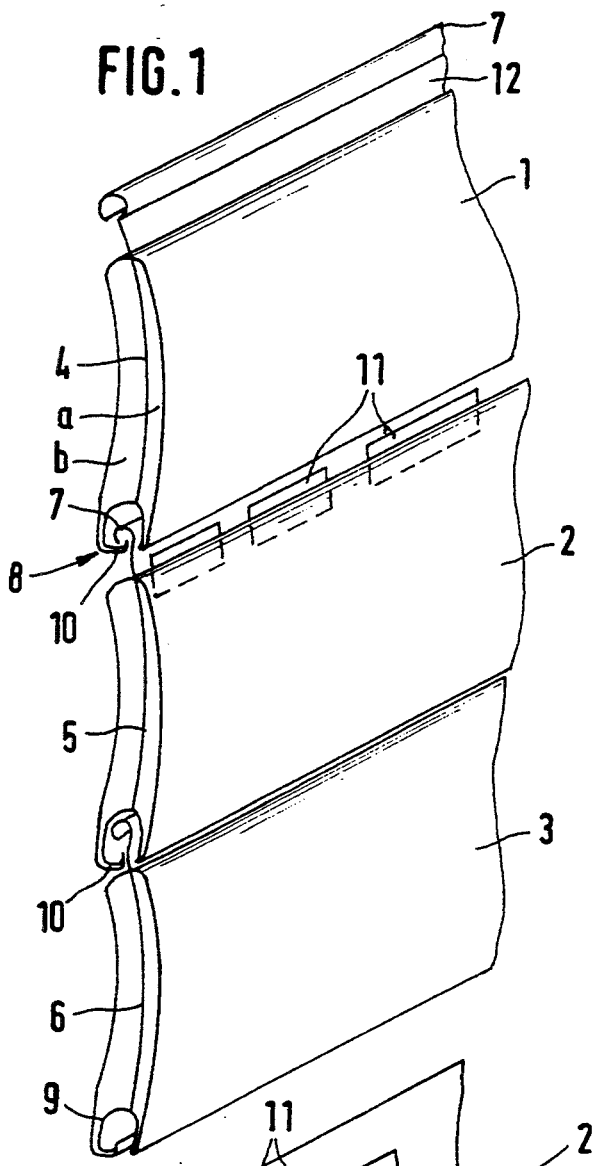
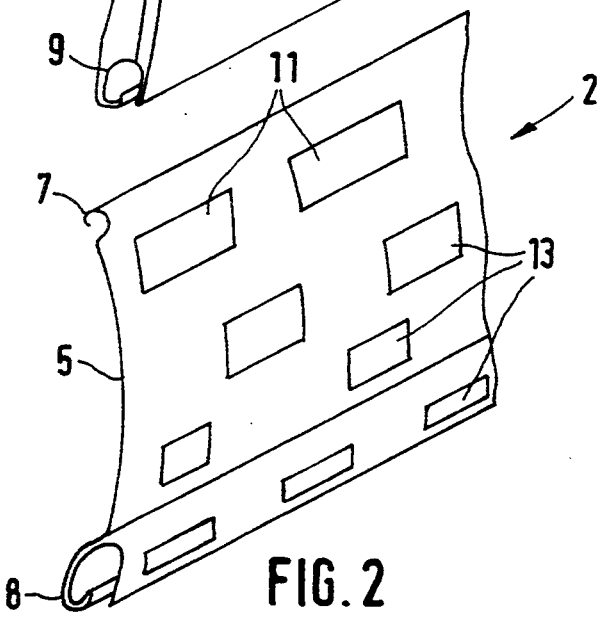
FIG. 2
FIG. 3
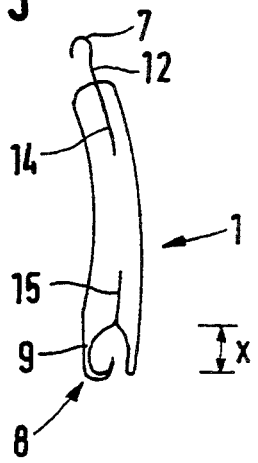
FIG. 4
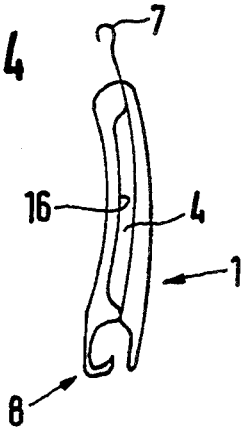
FIG. 5
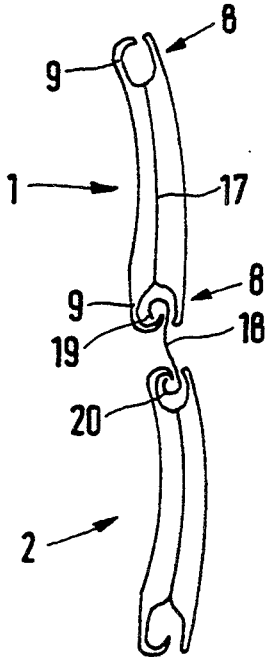

SLATTED CURTAIN FOR ROLLER BLINDS

The present invention relates to a slatted curtain for roller blinds according to the preamble of claim 1.

Such a slatted curtain is nowadays part of most roller blinds, in particular small roller blinds that are termed mini-roller blinds. Between the joint portions and the longitudinal edges of the slats there are frequently slot-like recesses for admitting light and for ventilation when the slatted curtain is drawn partly upward.

The slats are usually made of plastics or metal. Wooden strips were formerly also used, but roller blinds with slats consisting of wooden strips tend to be deformed—the slats tend in particular to sag—when the roller blind has been open for some time. Furthermore, the warp of the wooden strips in particular due to variations in moisture leads to operating trouble since the slats jam in the slide rails, and to the slats not closing properly.

There have been attempts to remedy this by providing accordingly thick and wide wooden strips. However, thick and wide wooden strips result in a large roll diameter and thus a large roller-blind box, and a high weight of the curtain. Furthermore, such wooden roller blinds have relatively low protection from burglary.

On the other hand, wood has a number of advantages compared to other materials. Being a natural material, wood is felt to be more pleasant than plastics, for example. A wooden curtain can also be combined esthetically with other wooden furnishings in or on the house. The great number of species of wood also allows for a great range of wooden curtains made of all kinds of different woods. Furthermore, wood can be painted in any desired color.

German "offenlegungsschrift" no. 25 05 682 discloses a slatted curtain according to the preamble of claim 1. The slats are made of heat insulating foamed material. The carrier element is inserted into a groove in the foam slat and connected therewith by glue. However, such a connection is not capable of interconnecting the slats of a slatted curtain firmly enough.

The invention is therefore based on the problem of providing a perfectly functioning, burglarproof slatted curtain, in particular for mini-roller blinds, made of wood but otherwise permitting the use of customary roller blind parts, such as roller-blind boxes, guide means, etc.

This is achieved according to the invention by the slatted curtain characterized in claim 1. The subclaims state advantageous embodiments of the invention.

According to the invention carrier elements on which the joint portions are provided are thus pressed or cast into the material, e.g. by extrusion. The resulting slats can be coated on one or both sides e.g. with a woody surface.

Since a compressed or cast wood is used according to the invention the carrier element can be pressed or cast into the compressed or cast wood without any trouble. This results in high strength of the wooden slats and high protection from burglary.

The compressed or cast wood can also be produced using wood-like substances, instead of from wood in the narrow sense. For example, crushed bark can be used to produce the compressed or cast wood.

In the following, several embodiments of the inventive slatted curtain shall be explained in more detail with reference to the drawing, in which:

FIG. 1 shows a perspective view of part of a roller blind slatted curtain;

FIG. 2 shows an embodiment of the carrier element in a perspective and partial view;

FIG. 3 shows a slat in the cross section with a further embodiment of the carrier element;

FIG. 4 shows in cross section another embodiment of a slat; and

FIG. 5 shows in cross section another interconnection of the slats.

According to FIG. 1 each of horizontal slats 1, 2, 3 of the curtain has a carrier element 4, 5, 6. Each carrier element 4, 5, 6 is formed as a strip, for example of metal, such as aluminum sheet, or plastics, that runs through substantially the entire length of slats 1, 2, 3.

For this purpose each slat 1, 2, 3 is produced from a compressed or cast wooden strip into which carrier element 4, 5, 6 is pressed or cast, for example by extrusion, in such a way that each carrier element 4, 5, 6 is coated with compressed or cast wood on both sides (a, b).

The compressed or cast wood can be produced from the desired species of wood and optionally provided with decorations on the surface.

Each carrier element 4, 5, 6 protrudes with its upper end out of slat 1, 2, 3. The upper end and the lower end are each provided with a hook-shaped joint portion 7, 8. Due to the interlocking of joint portions 7, 8 slats 1, 2, 3 are hinged with each other. While upper hook-shaped portion 7 is formed by rolling in the particular end of carrier element 4, 5, 6, lower portion 8 of each slat is formed as a groove integrated into the lower edge of slat 1, 2, 3. That is, lower hook-shaped portion 8 comprises a trough-shaped portion 9 of substantially U-shaped cross section in carrier element 4, 5, 6 with an inward bent edge 10 on which the lower edge of the other hook 7 rests, so that the two hooks 7, 8 engage each other.

Between the upper longitudinal edge of slats 1, 2, 3 and hook 7, carrier element 4, 5, 6 is provided with recesses or openings 11 that serve as light and ventilation slots. To permit them to perform this function trough-shaped portion 9 has a depth that is so great that not only hook 7 but total portion 12 protruding from slat 1, 2, 3 is insertable into trough-shaped portion 9.

When the roller blind is drawn partly upward, as shown in FIG. 1 for slat 1, recesses 11 in carrier element 5 of slat 2 disposed thereunder are thus unblocked, while when the roller blind is completely lowered, as shown in FIG. 1 for slats 2 and 3, slats 2, 3 lie firmly against each other, i.e. portions 12 with openings 11 of the carrier element lie in trough-shaped portion 9 so that openings 11 are closed. Trough-shaped portion 9 has for this purpose a depth x (FIG. 3). Since joint portions 7, 9 generally made of metal are thus concealed completely in slats 1, 2, 3 when the roller blind is completely lowered, all metal parts are removed from sunlight in the inventive roller blind. This prevents metal parts from being heated by sunlight so that the different thermal coefficients of the metal and wood material do not become noticeable and lead to a delamination of the metal and wood material.

Recesses 11 extend into slats 1, 2, 3, as shown by the broken line in slat 2 in FIG. 1. This binds together compressed or cast wood a, b on both sides of carrier elements 4, 5, 6, thereby obtaining a firm anchoring of the wood on carrier element 4, 5, 6.

Further recesses 13 in carrier element 11 in the area of the wood substantially strengthens this anchoring, as shown in FIG. 2.

In the area of recesses 11, 13 compressed and cast wood material a, b on both sides of carrier elements 4, 5, 6 is united into a massive integral connection, thereby ensuring a firm anchoring of the wood material on carrier element 4, 5, 6.

An additional special feature is that recesses 11 extending out of slats 1, 2, 3 beyond the longitudinal edge thereof to adjacent hook-shaped joint portion 7 not only integrally connect the wood material, but at the same time serve as light and ventilation slots.

In addition, the very different thermal expansion coefficients of a wood material and of metal, which is what carrier elements 4, 5, 6 are preferably made of, fundamentally cause a danger of delamination between the wood material and carrier element 4, 5, 6. This delamination virtually always begins on the edge of slat 1, 2, 3, i.e. on the longitudinal edge. However, due to recesses 11 in carrier element 5 on the longitudinal edge of the slat there is no more layer structure in the area of recesses 11, i.e. wood material a, b on both sides of carrier element 5 is united there, which accordingly reduces the danger of delamination on the longitudinal edge of the slat, in particular when recesses 11 are sufficiently wide, as shown in FIG. 1, i.e. together constitute for example more than half, preferably more than two thirds, of the length of the longitudinal edge of the slat.

According to FIG. 3 carrier element of slat 1 can also comprise two parts 14, 15, one part 14 extending on the upper edge of slat 1 and the other part 15 on the lower edge thereof. Parts 14, 15 can be made of different materials, for example lower part 15 with trough-shaped portion 9 of plastics and upper part 14 with rolled-in hook-shaped portion 7 of sheet metal. Parts 14 and 15 can also overlap, for example to increase the strength of slat 1.

According to FIG. 4 a cavity 16 can be provided in slat 1, e.g. on only one side of carrier element 4 but also in the compressed or cast wood or in the carrier element, in order to save weight or to increase the heat insulation.

It is also possible to use carrier elements 17 that are provided above and below with trough-shaped joint portions 9, as shown in FIG. 5, whereby an interlink 18 that is bent above and below into hook-shaped joint portions 19, 20 is provided for connecting slats 1, 2.

Slats 1, 2, 3 are connected by fitting cooperating joint portions 7, 8 or 9, 19 and 9, 20 into each other laterally.

Compressed or cast wood material is usually a mixture of dawdust and the like particulate wood material with a binder. The binder is usually a curable, thermosetting resin, for instance an acrylic resin, an alkyd resin, an amino resin, an epoxy resin, phenolic resin or unsaturated polyester resin. These resins are widely used as compression molding and casting materials and adhesives.

An example of compressed or cast wood material is so-called liquid wood which has been marketed for a number of years. It is available for instance from the company Frenkel Ges.m.b.H., located at A-2380 Perchtoldsdorf, Austria, and sold under the trademark "Grilith-Holzmasse". Liquid wood is commonly used for instance to fill a hole in a wooden article.

Coextrusion is preferred to incorporate the carrier elements in the slats. For instance, a band with a length of 10 meters having the cross section of the carrier elements, is fed axially through the extruder to the heated die which has a length about 10 cm to 1 m. The paste-like compressed or cast wood material is injected radially into the extruder before the die. After passing the die the coextruded product is essentially cured and is withdrawn from the extruder by drawing rolls for instance. After complete curing and cooling the product is cut into the desired lengths.

We claim:

1. A slatted curtain for roller blinds comprising plural slats, said slats having carrier elements that have joint portions for interconnecting said slats, said slats being formed from compressed or cast wood material, said carrier elements being cast or pressed into said wood material and having plural recesses, at least one of said recesses being positioned along at least one longitudinal free edge of said wood material and defining means for anchoring said wood material to said respective carrier element along said at least one longitudinal free edge, and ventilation means for permitting light and air to pass between adjacently disposed pairs of said slats.

2. The slatted curtain of claim 1, wherein each said carrier element includes first and second separate carrier element portions which extend away from first and second longitudinal free edges of said wood material respectively.

3. The slatted curtain of claim 1, in which two said joint portions form a joint between adjacent slats and comprise a hook-shaped joint portion protruding beyond the longitudinal edge of one said slat, and trough-shaped joint portion integrated into the adjacent longitudinal edge of the adjacent said slat.

4. The slatted curtain of claim 3, in which said trough-shaped joint portion has a depth (x) sufficient to allow the opposing longitudinal edges of said adjacent slats to contact.

5. The slatted curtain of claim 1, in which two said joint portions form a joint between adjacent slats and comprise a hook-shaped joint portion protruding beyond the longitudinal edge of one said slat, and a trough-shaped joint portion integrated into the adjacent longitudinal edge of the adjacent said slat, said trough-shaped joint portion having a depth (x) sufficient to allow the opposing longitudinal edges of said adjacent slats to contact.

6. A slat for a roller blind curtain comprising a wooden member including first and second wooden parts having mutually adjacent longitudinal free edges extending in a first direction, and a metallic carrier element cast or pressed between said first and second wooden parts, said carrier element having first and second joint members extending outwardly away from said respective longitudinal free edges along an axis transverse to said first direction and having a plurality of openings therein, at least one of said openings being positioned along at least one of said longitudinal free edges, said at least one of said openings having a first portion extending outwardly from said at least one of said longitudinal free edges along said axis to serve as a light and ventilation passage between the slat and a second slat of the curtain, and a second portion extending inwardly between said wooden parts from said first portion to permit said wooden parts to be joined together thus preventing said wooden parts from delaminating from said carrier element along said at least one of said longitudinal free edges.

7. The slat of claim 6, wherein said first joint member is separate from said second joint member.

8. The slat of claim 6, wherein said carrier element includes at least one cavity portion disposed between said wooden parts to increase heat insulating properties of the slat.

9. The slat of claim 6, wherein one of said joint members forms a hook-shaped portion and the other of said joint members forms a trough-shaped portion.

10. The slat of claim 9, wherein said trough-shaped portion has a depth (x) which permits said second slat to be relatively slidably movable with respect to the first-mentioned slat along said axis.

11. The slat of claim 6, wherein the first-mentioned slat is interconnected to said second slat by an interlink having third and fourth joint members.

12. The slat of claim 11, wherein said first and second joint members each include a trough-shaped portion, and wherein said third and fourth joint members each include a hook-shaped portion.

* * * * *